US009890948B2

(12) United States Patent
Assmann et al.

(10) Patent No.: US 9,890,948 B2
(45) Date of Patent: Feb. 13, 2018

(54) METHOD FOR PREHEATING FEED WATER IN STEAM POWER PLANTS, WITH PROCESS STEAM OUTCOUPLING

(71) Applicant: Siemens Aktiengesellschaft, Munich (DE)

(72) Inventors: Ingo Assmann, Nuremberg (DE); Tim Neuberg, Nuremberg (DE)

(73) Assignee: Siemens Aktiengesellschaft, Munich (DE)

( * ) Notice: Subject to any disclaimer, the term of this patent is extended or adjusted under 35 U.S.C. 154(b) by 22 days.

(21) Appl. No.: 14/898,140

(22) PCT Filed: Oct. 18, 2013

(86) PCT No.: PCT/EP2013/071814
§ 371 (c)(1),
(2) Date: Dec. 13, 2015

(87) PCT Pub. No.: WO2015/000536
PCT Pub. Date: Jan. 8, 2015

(65) Prior Publication Data

US 2016/0138798 A1 May 19, 2016

(30) Foreign Application Priority Data

Jul. 5, 2013 (EP) ..... 13175367

(51) Int. Cl.
*F22D 1/32* (2006.01)
*F22D 1/50* (2006.01)
(Continued)

(52) U.S. Cl.
CPC ..... *F22D 1/34* (2013.01); *F01K 7/40* (2013.01); *F01K 7/44* (2013.01); *F01K 9/00* (2013.01); *F22D 1/50* (2013.01); *F28B 9/00* (2013.01)

(58) Field of Classification Search
CPC ..... F28D 2021/0066; F28F 13/182; B01D 1/2287; F01K 23/04; F01K 7/44; F22D 1/34; F22D 1/32; F22D 1/50
See application file for complete search history.

(56) References Cited

U.S. PATENT DOCUMENTS 2,774,731 A 12/1956 Profos
4,089,304 A 5/1978 Beckmann
(Continued)

FOREIGN PATENT DOCUMENTS

CN 101115553 A 1/2008
CN 101208498 A 6/2008
(Continued)

OTHER PUBLICATIONS

CN Office Action dated Jul. 18, 2016, for CN application No. 201380078041.6.
(Continued)

*Primary Examiner* — Gregory A Wilson
(74) *Attorney, Agent, or Firm* — Beusse Wolter Sanks & Maire

(57) ABSTRACT

A system for supplying feed water for an evaporator in a water-steam circuit has a condenser for condensing steam to obtain water that can be supplied with steam from a turbine installation. A degasification device for degasing condensate is coupled to the condenser such that a first portion of the condensate of the condenser can be fed to the degasification device. The heat exchanger is coupled to the condenser such that a second portion of the condensate of the condenser can be fed to the heat exchanger, the heat exchanger being coupled to a supply line such that feed water can be fed to the heat exchanger. The heat exchanger is configured such that the feed water can be heated using the second portion of the condensate. The heat exchanger is coupled to the degas-
(Continued)

ification device such that the heated feed water can be fed to the degasification device.

17 Claims, 1 Drawing Sheet

(51) Int. Cl.

| | |
|---|---|
| ***F22D 1/34*** | (2006.01) |
| ***F01K 7/40*** | (2006.01) |
| ***F01K 7/44*** | (2006.01) |
| ***F01K 9/00*** | (2006.01) |
| ***F28B 9/00*** | (2006.01) |

(56) References Cited

U.S. PATENT DOCUMENTS

| | | | | |
|---|---|---|---|---|
| 4,660,511 | A * | 4/1987 | Anderson | F01K 23/04 122/1 C |
| 6,318,087 | B1 | 11/2001 | Baumann et al. | |
| 2006/0118064 | A1 | 6/2006 | Istre et al. | |
| 2010/0132362 | A1* | 6/2010 | Herbermann | F01K 9/00 60/688 |
| 2012/0102962 | A1* | 5/2012 | Sivasankaran | F01K 23/10 60/772 |
| 2013/0263928 | A1 | 10/2013 | Inoue et al. | |
| 2014/0202399 | A1* | 7/2014 | Nadig | F22B 37/30 122/489 |
| 2014/0208752 | A1* | 7/2014 | Palanisamy | F01K 3/004 60/648 |
| 2015/0007567 | A1* | 1/2015 | Manzoni | F03G 6/067 60/645 |

FOREIGN PATENT DOCUMENTS

| | | | |
|---|---|---|---|
| CN | 202973063 | U | 6/2013 |
| DE | 10200504380 | B3 | 7/2006 |
| DE | 102005040380 | B3 | 7/2006 |
| EP | 0158629 | A2 | 10/1985 |
| EP | 0158629 | A3 | 10/1985 |
| EP | 1093836 | A1 | 4/2001 |
| RU | 2116559 | C1 | 7/1998 |
| WO | 201290778 | A1 | 6/2012 |

OTHER PUBLICATIONS

RU Notice of Allowance dated May 15, 2017, for RU patent application No. 2016103736.

EP Examination Report dated Jul. 31, 2017, for EP patent application No. 13779573.8.

* cited by examiner

METHOD FOR PREHEATING FEED WATER IN STEAM POWER PLANTS, WITH PROCESS STEAM OUTCOUPLING

CROSS REFERENCE TO RELATED APPLICATIONS

This application is the US National Stage of International Application No. PCT/EP2013/071814 filed Oct. 18, 2013, and claims the benefit thereof. The International Application claims the benefit of European Application No. EP13175367 filed Jul. 5, 2013. All of the applications are incorporated by reference herein in their entirety.

FIELD OF INVENTION

The present invention relates to a system for feeding makeup water into a water steam circuit, and preheating said makeup water, in a steam power plant. In addition, the present invention relates to a method for degasifying makeup water in a water steam circuit in a steam power plant.

BACKGROUND OF THE INVENTION

When process steam/heat in steam power plants is extracted, owing to leakages and losses of process steam/condensate, the water-steam circuit has to be made up by means of the continuous feeding in of makeup water. The makeup water is as a rule prepared but not degasified. For example, the makeup water contains dissolved foreign gases which have to be expelled again in a degasser of the steam power process. In order to increase the process efficiency, the makeup water has to be preheated before entry into the degasser.

At present, the makeup water is supplied, for example, to a conventional degasification device, directly into the degasser. This is technically simple and involves less cost, but is the most unfavorable variant in terms of energy.

In addition, the makeup water can be fed directly into a turbine condenser or into a low pressure preheater. This variant can, however, only be applied for relatively small quantities of makeup water.

FIG. 2 illustrates a further conventional system for feeding makeup water into a water-steam circuit. The condensate from a conventional condenser 201 is pumped into a container 204 by a conventional condensate pump 202. In addition, a mass flow m, of the makeup water is mixed in there by means of a conventional feed line 203. The water mixture is subsequently pumped into the conventional degasification device 209 by a further condensate pump 205 through conventional heating devices 206, 208 of the water-steam circuit. Since the water mixture is not degasified owing to the makeup water portion and therefore contains dissolved and corrosive media (for example oxygen), all the containers, lines and fittings, including the container 204 up to the conventional degasification device, have to be constructed from corrosion-free stainless steel. The water is fed to a conventional evaporator 207 downstream of the conventional degasification device 209.

SUMMARY OF THE INVENTION

An object of the present invention is to degasify makeup water for a water-steam circuit of a steam power plant in a way which is efficient in terms of energy and costs.

This object is achieved with a system for feeding makeup water via an extra condensate-makeup water preheater of a water-steam circuit in a steam power plant, and with a method for degasifying makeup water in a downstream degasser of a water-steam circuit in a steam power plant according to the independent claims.

According to a first aspect of the present invention, a system for feeding makeup water for a preheater and/or evaporator of a water-steam circuit in a steam power plant is described. The system has a condenser for condensing steam to form water, a degasification device for degasifying water, a feed line for feeding in makeup water, and a heat exchanger.

The condenser for condensing steam to form water (referred to below as "condensate" for the sake of better differentiation) can be supplied with steam from a turbine system of the steam power plant. The degasification device for degasifying water is coupled to the condenser in such a way that a first portion of the condensate can be fed to the degasification device. The heat exchanger is coupled to the condenser in such a way that a second portion of the condensate can be fed to the heat exchanger, wherein the heat exchanger is coupled to a feed line in such a way that makeup water can be fed to the heat exchanger. The heat exchanger is configured in such a way that the makeup water can be heated by means of the second portion of the condensate. The heat exchanger is coupled to the degasification device in such a way that the heated makeup water can be fed to the degasification device.

According to a further aspect of the present invention, a method for degasifying makeup water for an evaporator of a water-steam circuit in a steam power plant is described.

Steam power plants are frequently used nowadays to generate electrical energy. The steam which is necessary to operate the steam turbine is generated in a steam boiler from previously purified and prepared water. Further heating of the steam in the superheater causes the temperature and the specific volume of the steam to increase. The steam flows from the steam boiler via pipelines into a steam turbine system where it outputs a portion of its previously absorbed energy as kinetic energy to the turbine system. A generator, which converts the mechanical power into electrical power, is coupled to the turbine. The expanded and cooled steam then flows into the condenser where it condenses by transmitting heat to the surroundings (for example fresh water from a river) and collects as liquid water at the lowest point of the condenser. This water is referred to as condensate. The water is buffered, for example, in a supply water vessel via the condensate pumps and preheaters or heating devices, and then fed again to the steam boiler or the evaporator via a further condensate pump.

Before the water is buffered in the supply water vessel and correspondingly fed to the evaporator, the water is fed to the degasification device in order to largely remove noxious gases such as, for example, corrosive oxygen or carbon dioxide.

The degasification device according to the present invention can operate by means of a thermal degasification method or by means of a chemical degasification method. In the thermal degasification method, thermal energy, for example from extraction steam (from the medium pressure range) of the turbine system is fed to the degasification device, with the result that the water in the degasification device "comes to the boil" and is therefore heated. As a result, the noxious gases, such as oxygen and carbon dioxide, are largely removed. For the degasification, the physical fact that the solubility of gases in liquids drops as the temperature increases is exploited.

According to the present invention, condensate from the condenser, firstly, and makeup water which was previously heated in the heat exchanger, are fed to the degasification device. The makeup water is necessary, since water and steam in the water-steam circuit escape from the water-steam circuit owing to leakages. This relates, in particular, to systems with external heat consumers, that is to say systems with extraction of process steam.

According to the present invention, a heat exchanger is made available which contains, on the one hand, the second portion of the condensate. In addition, a desired quantity of makeup water is added to the heat exchanger via a feed line. The heat exchanger is configured to heat the makeup water to a desired temperature by means of the heat of the second portion of the condensate. The heated makeup water is subsequently fed (in particular directly) to the degasification device.

The heat exchanger according the present invention is, in particular, a condensate/makeup water heat exchanger. This means that the heat-emitting fluid (here the second portion of the water or of the condensate) does not change its aggregate state and remains liquid, and also the heat-absorbing fluid (here the makeup water) remains liquid and does not change its aggregate state. This results in a very compact design of the heat exchanger compared to condensing heat exchangers.

Since the makeup water is heated in a separate heat exchanger by means of the heat of a second portion of the condensate from the condenser and is subsequently fed in the heated state directly to the degasification device, the system according to the invention is very efficient energetically.

In addition, the makeup water, which can contain noxious gases, is not mixed with the first portion of the condensate until the degasification device. It is therefore possible that the devices (for example heating devices and condensate pumps) as well as the pipelines which may be present between the condenser the degasification device do not necessarily have to be constructed from corrosion-resistant stainless steel, since these devices and pipelines do not come into contact with the corrosive makeup water. With the system according to the present invention it is therefore possible to use not only the extremely energy-efficient design but also more favorable materials for the devices and pipelines between the condenser and the degasification device.

The second portion of the condensate can be smaller than the first portion of the water by at least half. The second portion of the condensate is, in particular, not branched off from the total amount of condensate until downstream of the condenser and downstream of at least one heating device, with the result that the second portion of water has already been heated by means of a heating device before the second portion of the water is fed to the heat exchanger.

According to a further exemplary embodiment, the heat exchanger is coupled to the degasification device in such a way that the second portion of the condensate can be fed to the degasification device after passing through the heat exchanger. Therefore, for example the second portion of the water is mixed with the makeup water and therefore an average temperature between the second portion of the water and the makeup water is set. The makeup water is therefore also heated. The mixture of the second portion of the condensate and the makeup water is subsequently mixed with the first portion of the water in the degasification device.

According to a further exemplary embodiment, the heat exchanger can also be coupled to the condenser in such a way that the second portion of the condensate can be fed again to the condenser after passing through the heat exchanger. As a result, the second portion of the condensate can be mixed again with the water in the condenser and subsequently fed to the water-steam process again. In particular, in a further exemplary embodiment of the invention, the second portion of the condensate is supplied downstream of the condenser and upstream of the heating device after flowing through the heat exchanger, and is mixed with the total amount of the water from the condenser.

According to a further exemplary embodiment, the system has the heating device for heating the water. The heating device is coupled to the condenser in such a way that the condensate can be fed to the heating device. The heating device is coupled to the degasification device in such a way that the heated water, or at least the first portion of the condensate, can be fed to the degasification device.

According to a further exemplary embodiment, the heating device is configured in such a way that the heating device for heating the water can be supplied with steam from the turbine system, in particular from a low pressure range of the turbine system of the steam power plant. In other words, the extraction steam is extracted from the turbine system in order to use the thermal energy of the extraction steam to heat the water downstream of the condenser. The medium pressure range of the turbine system is, in particular, a range which is close to the last turbine stage of the turbine system by virtue of the fact that the steam still has a relatively high level of thermal energy but a relatively low pressure.

According to a further exemplary embodiment, the heating device is coupled between the condenser and the heat exchanger in such a way that the second portion of the condensate can be branched off after the heating of the makeup water in the heating device and can be fed to the heat exchanger.

According to a further exemplary embodiment, the degasification device is configured in such a way that, in order to degasify the water (that is to say the first portion of the condensate and the makeup water heated in the heat exchanger), the degasification device can be supplied with steam from the turbine system, in particular from the low pressure range and/or the medium pressure range of the turbine system, of the steam power plant.

According to a further exemplary embodiment, the system also has a condensate pump which is arranged between the condenser and the degasification device in order to increase the pressure of the water.

With the present invention, the makeup water is not mixed with the condensate until in the degasification device. In order to avoid having to accept any reductions in efficiency as a result of a lack of preheating, the makeup water is heated in the condensate/makeup water heat exchanger by means of a partial stream (the second portion) of the second portion of the condensate which has already been preheated in the low pressure preheaters (heating devices). The second portion of the condensate which is used for heating can be extracted from any desired number of upstream low pressure preheaters and then used for preheating the makeup water in one or more condensate/makeup water heat exchangers. The extraction of the second portion of the water (i.e. of the preheating condensate) between the last heating device (low pressure preheater) and the degasification device is energetically appropriate. In one exemplary embodiment, the second portion of the water (condensate) which is used for preheating is fed back to the turbine condenser after the cooling in the condensate/makeup water heat exchanger.

The second portion of the condensate mass flow which is branched off for preheating the makeup water is preheated by energetically low-value extraction steam, for example from the expansion run of the steam turbine system. With the present invention, a relatively high overall efficiency can be achieved by using energetically low-value low pressure extraction steam from the expansion run of the steam turbine system.

In addition, the construction of the low pressure preheater which is used and which comes into contact with the non-degasified makeup water from corrosion-free steel (for example stainless steel) is dispensed with.

In addition, for example the need to mix the makeup water with the water/condensate in a separate condensate tank is dispensed with. The condensate pump downstream of the condenser therefore only pumps the total amount of water (condensate), which has already been degasified and therefore is less corrosive.

By virtue of the system described above it also becomes economically appropriate to combine the preheating of the makeup water by means of exhaust gas heat exchangers in conjunction with the additional condensate/makeup water heat exchanger. This is made possible because the exhaust gas heating surfaces (installed in this case, for example, as economizers in the exhaust gas duct of refuse burning systems or combined gas and steam power plants) do not have a flow of non-degasified water through them. In addition, as a result of the downstream preheating of the makeup water by means of the partial stream of the condensate, the complicated construction of the heating surfaces of the economizers from special steels (heat-resistant and corrosion-resistant) can be dispensed with.

Compared to conventional systems, the cost of the system can be reduced and, for example, the base area of a machinery house can be made smaller because the additionally installed preheaters for heating the makeup water can be dispensed with (they are necessary in particular in the case of large quantities of makeup water). As a result, the costs for the power plant components are lowered considerably. Furthermore, a very large mass flow of makeup water can be processed. This mass flow of makeup water can exceed the quantity of condensate by more than twice.

It is to be noted that the embodiments described here constitute merely a limited number of possible embodiment variants of the invention. It is therefore possible to combine the features of individual embodiments with one another in a suitable way, with the result that for a person skilled in the art, the embodiment variants which are explicit here can be considered to clearly disclose a multiplicity of different embodiments.

BRIEF DESCRIPTION OF THE DRAWINGS

In the text which follows, exemplary embodiments will be described in more detail with reference to the appended figures for the sake of further explanation and for better understanding of the present invention.

DETAILED DESCRIPTION OF EXEMPLARY EMBODIMENTS

Identical or similar components are provided with identical reference symbols in the figures. The illustrations in the figures are schematic and not to scale.

Figure 1:
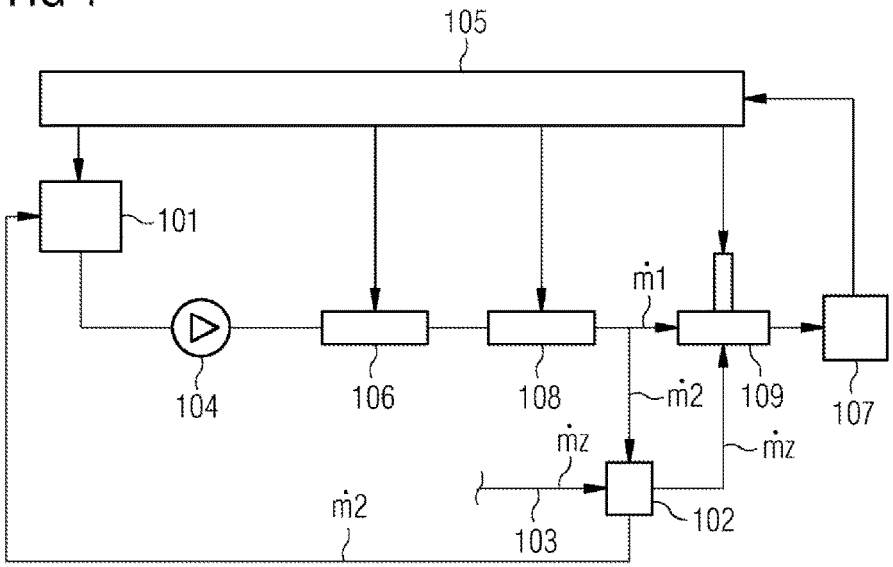
FIG. 1 shows a schematic illustration of a system for feeding makeup water into a water-steam circuit of a steam power plant according to an exemplary embodiment of the present invention.
Figure 2:
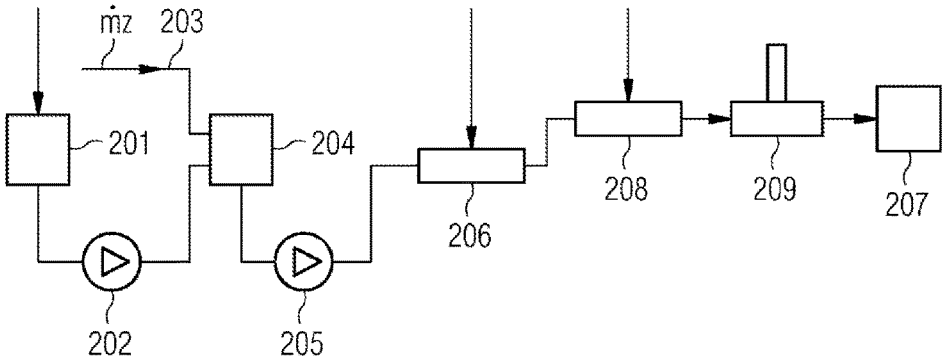
FIG 2 Prior Art
FIG. 2 shows a conventional system for feeding makeup water into a water-steam circuit of a steam power plant.

FIG. 1 shows a system for feeding makeup water into a water-steam circuit of a steam power plant. A condenser 101 for condensing steam to form water (this water is referred to below as condensate) can be supplied with steam from a turbine system 105 of the steam power plant. A degasification device 109 for degasifying condensate is coupled to the condenser 101 in such a way that a first portion of the condensate of the condenser 101 can be fed to the degasifying device 109. The heat exchanger 102 is coupled to the condenser 101 in such a way that a second portion of the condensate of the condenser 101 can be fed to the condensate/makeup water heat exchanger 102, wherein the heat exchanger 102 is coupled to a feed line 103 in such a way that the makeup water can be fed to the heat exchanger 102. The heat exchanger 102 is configured in such a way that the makeup water can be heated by means of the second portion of the condensate. The heat exchanger 102 is coupled to the degasification device 109 in such a way that the heated makeup water can be fed to the degasification device 109. The water is fed, for example, to an evaporator 107 downstream of the degasification device 109.

In particular, the heated makeup water is supplied to the degasification device 109 directly downstream of the heat exchanger 102 and is not mixed with the first portion or the first mass flow M1 of the condensate of the condenser 101 until in the degasification device 109.

The heat exchanger 102 can be coupled to the degasification device 109 in such a way that the second portion (or a second mass flow $m_2$) of the condensate can be fed to the degasification device 109 after passing through the heat exchanger 102. Alternatively, as illustrated in FIG. 1, the heat exchanger 102 can be coupled to the condenser 101 in such a way that the second portion of the condensate can be fed to the condenser 101 after passing through the heat exchanger 102.

At least one heating device 106 or, for example, a further multiplicity of further heating devices 108, can be coupled between the condenser 101 and the degasification device 109. The heating devices 106, 108 heat the entire mass flow of the water which flows from the condenser 101 in the direction of the degasification device 109. As is illustrated, for example, in FIG. 1, the second portion (the second mass flow $m_2$) of the condensate can be branched off after running through all the heating devices 108, and can be fed to the heat exchanger 102. Downstream of the tapping of the second portion, the first portion (first mass flow $m_1$) of the condensate flows directly into the degasification device 109 in which the first portion of the condensate is mixed with the makeup water $m_z$ heated in the heat exchanger 102.

The heating devices 106, 108 can be configured in such a way that, in order to heat the condensate, the heating devices 106, 108 can be supplied with steam (extraction steam) from the turbine system 105, in particular from a low pressure range of the turbine system 105, of the steam power plant.

The degasification device 109 is configured in such a way that, in order to degasify the water, the degasification device 109 can be supplied with steam from the turbine system 105, in particular from a low pressure range of the turbine system 105, of the steam power plant.

In addition, a condensate pump 104 can be coupled upstream or downstream of the heating devices 106, 108 in order to increase the pressure of the overall mass flow of the water downstream of the condenser 101.

In addition it is to be noted that "comprising" does not exclude any other elements or steps, and "a" or "an" does not exclude a plurality. In addition, it is to be noted that features or steps which have been described with reference to one of the above exemplary embodiments can also be used in combination with other features or steps of other exemplary embodiments described above. Reference symbols in the claims are not to be considered as restrictive.

The invention claimed is:

1. A system for feeding makeup water for an evaporator of a water steam circuit, the system comprising:

a condenser for condensing steam to form condensate, wherein the condenser is adapted to be supplied with steam from a turbine system, a degasification device for degasifying the condensate, wherein the degasification device is coupled to the condenser in such a way that a first portion of the condensate is adapted to be fed to the degasification device, a feed line for feeding in the makeup water, a heat exchanger, wherein the heat exchanger is coupled to the condenser in such a way that a second portion of the condensate of the condenser is adapted to be fed to the heat exchanger, wherein the heat exchanger is coupled to the feed line in such a way that the makeup water is adapted to be fed to the heat exchanger, wherein the heat exchanger is configured in such a way that the makeup water is adapted to be heated by means of the second portion of the condensate of the condenser, and wherein the heat exchanger is coupled to the degasification device in such a way that heated makeup water is adapted to be fed to the degasification device, and a heating device for heating the condensate of the condenser, wherein the heating device is coupled to the condenser in such a way that the condensate of the condenser is adapted to be fed to the heating device, and wherein the heating device is coupled to the degasification device in such a way that heated condensate is adapted to be fed to the degasification device.

2. The system as claimed in claim 1, wherein the heat exchanger is coupled to the degasification device in such a way that the second portion of the condensate of the condenser is adapted to be fed to the degasification device after passing through the heat exchanger.

3. The system as claimed in claim 1, wherein the heat exchanger is coupled to the condenser in such a way that the second portion of the condensate of the condenser is adapted to be fed to the condenser after passing through the heat exchanger.

4. The system as claimed in claim 1, wherein the heating device is configured in such a way that the heating device for heating the condensate of the condenser is adapted to be supplied with steam from the turbine system.

5. The system as claimed in claim 4, wherein the heating device for heating the condensate of the condenser is adapted to be supplied with steam from a medium pressure range and/or low pressure range of the turbine system.

6. The system as claimed in claim 1, wherein the heating device is coupled between the condenser and the heat exchanger in such a way that the second portion of the condensate is adapted to be tapped after the heating of the condensate of the condenser in the heating device and is adapted to be fed to the heat exchanger.

7. The system as claimed in claim 1, wherein the degasification device is configured in such a way that, in order to degasify the water, the degasification device is adapted to be supplied with steam from the turbine system.

8. The system as claimed in 7, wherein the degasification device is adapted to be supplied with steam from a medium pressure range and/or low pressure range of the turbine system.

9. The system as claimed in claim 1, further comprising a condensate pump, wherein, in order to increase a pressure of the condensate of the condenser, the condensate pump is arranged between the condenser and the degasification device.

10. A method for degasifying makeup water for an evaporator of a water steam circuit, the method comprising condensing a steam to form condensate by means of a condenser, wherein the condenser is supplied with steam from a turbine system, degasifying the condensate by means of a degasification device, wherein the degasification device is coupled to the condenser in such a way that a first portion of the condensate of the condenser is adapted to be fed to the degasification device, heating the condensate between the condenser and the degasification device via a heating device, feeding a second portion of the condensate of the condenser to a heat exchanger, feeding makeup water from a feed line to the heat exchanger, heating the makeup water by means of the second portion of the condensate of the condenser in the heat exchanger, and feeding heated makeup condensate from the heat exchanger to the degasification device.

11. A system for feeding makeup water to a water steam circuit, the system comprising:

a water steam circuit, a turbine system, a condenser, a degasification device, a heat exchanger, and a makeup feedwater feed line, wherein the water steam circuit is configured to flow a working fluid through the turbine system, then to the condenser, then to the degasification unit, and back to the turbine system, wherein the condenser is configured to receive the working fluid as steam and to condense the steam to form a main flow of condensate, wherein the water steam circuit is configured to deliver a first portion of the main flow of condensate from a location where the main flow of condensate is flowing from the condenser toward the degasification unit and to deliver the first portion to the degasification unit, wherein the water steam circuit is configured to deliver a second portion of the main flow of condensate from the location and to deliver the second portion to the heat exchanger, wherein the heat exchanger is configured to receive makeup water from the makeup water feed line, heat the makeup water via a heat exchange process with the second portion of the main flow of condensate, and deliver heated makeup water directly to the degasification unit.

12. The system as claimed in claim 11, wherein the water steam circuit is configured to deliver the second portion from the heat exchanger to the degasification device.

13. The system as claimed in claim 11, wherein the water steam circuit is configured to deliver the second portion from the heat exchanger to the condenser.

14. The system as claimed in claim 11, further comprising:

a heating device disposed between the condenser and the degasification unit and configured to heat the main flow of condensate.

15. The system as claimed in claim 14, wherein the water steam circuit is configured to supply steam from the turbine system to the heating device.

16. The system as claimed in claim 14, wherein the heating device is disposed between the condenser and the location.

17. The system as claimed in claim 11, further comprising a condensate pump disposed between the condenser and the degasification device.

* * * * *